United States Patent [19]

Miyamoto et al.

[11] 4,101,690

[45] Jul. 18, 1978

[54] DESENSITIZING COMPOSITION

[75] Inventors: Akio Miyamoto; Hiroharu Matsukawa, both of Shizuoka, Japan

[73] Assignee: Fuji Photo Film Co., Ltd., Kanagawa, Japan

[21] Appl. No.: 527,383

[22] Filed: Nov. 26, 1974

[30] Foreign Application Priority Data

Nov. 26, 1973 [JP] Japan ..... 48-132331

[51] Int. Cl.[2] ..... B41M 5/12

[52] U.S. Cl. ..... 427/150; 106/19; 106/21; 106/23; 260/584 B; 260/37 R; 282/27.5; 427/151; 427/152; 427/337; 428/195; 428/207; 428/913; 428/914

[58] Field of Search ..... 427/150, 151, 152, 337; 260/570.8, 570.9, 571, 584 R, 584 B, 37 R; 252/548; 8/42 R, 43, 54; 96/101; 428/195, 207, 913, 914, 411; 282/27.5; 106/19, 21, 23

[56] References Cited

U.S. PATENT DOCUMENTS

| | | | |
|---|---|---|---|
| 2,792,369 | 5/1957 | Dickson | 260/584 B |
| 2,792,370 | 5/1957 | Dickson | 260/584 B |
| 2,792,371 | 5/1957 | Dickson | 260/584 B |
| 3,036,130 | 5/1962 | Jackson et al. | 260/584 B |
| 3,049,392 | 8/1962 | Casty et al. | 8/54 |
| 3,086,832 | 4/1963 | Casty | 8/54 |
| 3,189,653 | 6/1965 | Rudner et al. | 260/584 B |
| 3,206,511 | 9/1965 | Bindler et al. | 8/54 |
| 3,218,116 | 11/1965 | Casty | 8/54 |
| 3,356,727 | 12/1967 | Koebner et al. | 252/548 |
| 3,529,922 | 9/1970 | Berger | 8/54 |
| 3,561,914 | 2/1971 | Abel et al. | 8/43 |
| 3,900,218 | 8/1975 | Miyamoto et al. | 282/27.5 |
| 3,931,430 | 1/1976 | Tada et al. | 428/195 |

FOREIGN PATENT DOCUMENTS

| | | | |
|---|---|---|---|
| 832,343 | 1/1970 | Canada. | |
| 4,629,546 | 8/1971 | Japan | 428/307 |

*Primary Examiner*—Ralph S. Kendall
*Assistant Examiner*—John D. Smith
*Attorney, Agent, or Firm*—Sughrue, Rothwell, Mion, Zinn and Macpeak

[57] ABSTRACT

A desensitizing composition for a color developer capable of coloring a substantially colorless color former, which desensitizing composition contains a compound represented by the following general formula (I)

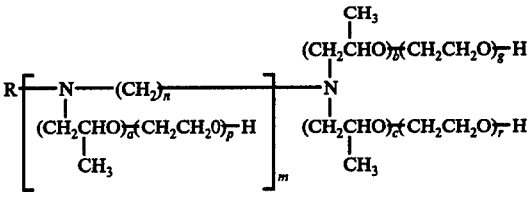

(I)

wherein R has from 2 to 20 carbon atoms and represents an alkyl group, an alkenyl group, an aryl group, an aralkyl group or a

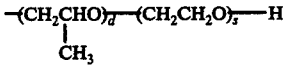

group; *m* is 0 or an integer of 1 to 3; *n* is an integer of 2 to 6; the sum of *a, b* and *c* is an integer of 3 to 100, the sum of *a, b, c* and *d* is an integer of 4 to 100; the sum of *p, q* and *r* is an integer of 3 to 100; and the sum of *p, q, r* and *s* is an integer of 4 to 100.

11 Claims, No Drawings

DESENSITIZING COMPOSITION

BACKGROUND OF THE INVENTION

1. Field of the Invention

This invention relates to a desensitizing composition and more specifically relates to a desensitizing composition which reduces or eliminates the effect of a color developer (a solid acid) capable of coloring a color former (a substantially colorless electron donating organic compound).

2. Description of the Prior Art

It has long been known to obtain a color image by the reaction of a color former and a color developer. The principle is practically utilized in pressure-sensitive copying sheets (for example, as disclosed in U.S. Pat. Nos. 2,505,470; 2,505,489; 2,550,471; 2,548,366; 2,712,507; 2,730,456; 2,730,457 and 3,418,250) and heat-sensitive recording sheets (for example, as disclosed in Japanese Patent Publication No. 4,160/68 and U.S. Pat. No. 2,939,009). Furthermore, a printing method is also known in which a color image is formed by supplying an ink containing a color former through a medium such as a stencil to a sheet coated with a color developer (for example, as disclosed in German Patent Laid-Open Application No. 1,939,962).

Pressure-sensitive copying sheets can be prepared by dissolving a color former in a solvent such as chlorinated paraffin, alkylnaphthalene, alkylated diphenylethane or alkylated diphenylmethane, dispersing the solution in a binder or incorporating the solution in microcapsules, and then coating the dispersion or microcapsules on a support such as papers or plastic films, on the one hand, and coating on acid clay, a phenol-formaldehyde resin, metal salts of aromatic carboxylic acids, or the like, as a color developer, on the other hand.

Heat-sensitive recording sheets can be prepared by coating a color former and a color developer together with a heat-fusible substance such as acetanilide on a support. A heat-fusible substance is a substance which melts on heating and dissolves the color former.

Generally, a color former and a color developer are coated over the entire surface of the same side or the opposite sides of a support or the surfaces of different supports. Therefore, it is necessary to prevent a color reaction using some method in the portions in which the formation of a color image is not desired or not required. For this purpose, a desensitizing agent is usually coated by printing the desensitizing agent in selected areas on a layer coated with a color developer to prevent a color reaction.

Known desensitizing agents are, for example, high molecular weight primary alkylamines such as dodecylamine and quaternary ammonium salts such as dodecyltrimethylammonium chloride as described in U.S. Pat. No. 2,777,780; tertiary amines such as monoalkylamine-, aralkylamine- or ethanolamineethylene oxide adducts as described in Japanese Patent Publication No. 29,546/71; or secondary alkylamines such as didodecylamine, tertiary alkylamines such as triethylamine, primary arylamines such as aniline or aralkylamines such as benzylamine.

However, conventional desensitizing agents have their respective disadvantages, and it is, therefore, desired to develop better desensitizing agents. For example, most of the conventional desensitizing agents exhibit insufficient desensitizing effects and, particularly, are not equally effective with respect to all types of color developers.

Conventional desensitizing agents which exhibit high desensitizing effects are higly water-soluble and hygroscopic and, when desensitizing compositions are prepared using these desensitizing agents, the desensitizing compositions absorb moisture (particularly, in a high humidity environment) and the binder precipitates. This causes the viscosity of the desensitizing compositions to be insufficient, so that the desensitizing compositions can not be smoothly coated. Also, wavelike wrinkles occur in the surface coated with the desensitizing agent. Moreover, when the desensitizing agent is left together with microcapsules, moisture in the atmosphere which is absorbed in the desensitizing agent causes the membranes of the microcapsules to swell, and as the case may be, even destroys the membranes. As a barely hygroscopic desensitizing agent, an adduct of an amine and propylene oxide is disclosed in Japanese Patent Laid-Open Application No. 6,805/73. However, this desensitizing agent has a disadvantage that the desensitizing effect of this agent is inferior to that of an adduct of an amine and ethylene oxide (as disclosed in Japanese Patent Publication No. 29,546/71) which has been generally used so far. Particularly, the desensitizing effect of the adduct of an amine and propylene oxide is insufficient for color formers of the xanthene series such as 7-diethylamino-3-benzylaminofluoran.

SUMMARY OF THE INVENTION

An object of this invention is to provide a desensitizing agent which exhibits extremely high desensitizing effects on all types of color formers.

Another object of this invention is to provide a desensitizing agent which exhibits extremely high desensitizing effects on all types of color developers.

Still another object of this invention is to provide a desenstizing agent which is not hygroscopic.

A further object of this invention is to provide a desensitizing agent which does not destroy microcapsules nor cause microcapsules to swell.

Still a further object of this invention is to provide a desensitizing composition which does not yellow on ageing.

It has been found that the above objects of this invention can be completely accomplished with a desensitizing composition containing as a desensitizing agent a compound represented by the following general formula (I)

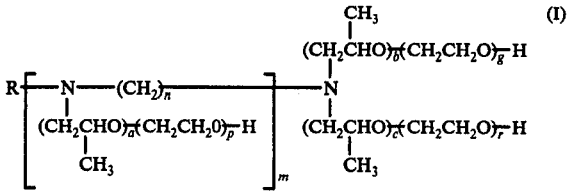

(I)

wherein R has 2 to 20 carbon atoms and represents an alkyl group, an alkenyl group, an aryl group, an aralkyl group or a

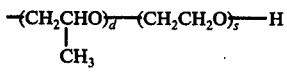

group; $m$ is 0 or an integer of 1 to 3; $n$ is an integer of 2 to 6; the sum of $a$, $b$ and $c$ is an integer of 3 to 100; the sum of $a$, $b$, $c$ and $d$ is an integer of 4 to 100; the sum of $p$, $q$ and $r$ is an integer of 3 to 100; and the sum of $p$, $q$, $r$ and $s$ is an integer of 4 to 100.

DETAILED DESCRIPTION OF THE INVENTION

In the above general formula (I), it is particularly preferred that the sum of $a$, $b$, $c$ and ($d$) is 4 to 70, the sum of $p$, $q$, $r$ and ($s$) is 4 to 60, the ratio of $a + b + c +$ ($d$) to $p + g + r +$ ($s$) is 1:5 to 20:1, and $n$ is 2 or 3.

Suitable examples of alkyl groups for R are alkyl groups having 2 to 20 carbon atoms such as dodecyl, tetradecyl, hexadecyl, octadecyl, etc., of alkenyl groups for R are alkenyl groups having 2 to 20 carbon atoms such as dodecenyl, tetradecenyl, hexadecenyl, octadecenyl, etc., of aryl groups for R are aryl groups having 6 to 20 carbon atoms such as phenyl, tolyl, naphthyl, α-methylnaphthyl, etc., and of aralkyl groups for R are aralkyl groups having 7 to 20 carbon atoms such as benzyl, phenethyl, etc.

Typical examples of the compounds represented by the above general formula (I) are given below.

Compound 1

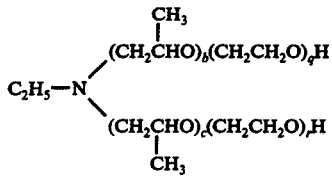

(b + c = 5, q + r = 10)

Compound 2

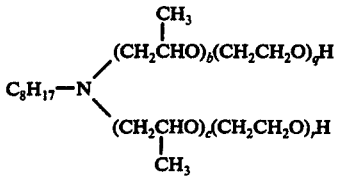

(b + c = 10, q + r = 15)

Compound 3

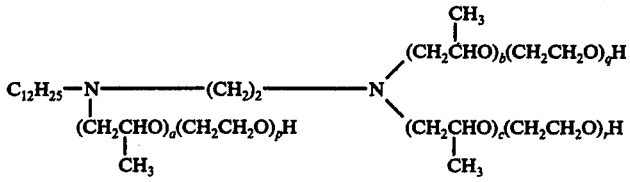

(a + b + c = 30, p + q + r = 10)

Compound 4

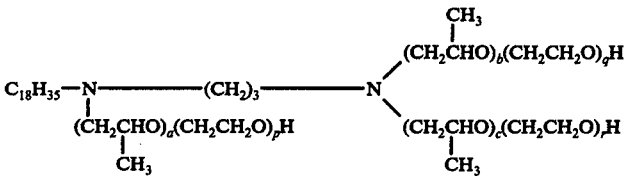

(a + b + c = 100, p + q + r = 20)

Compound 5

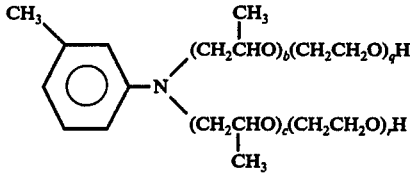

(b + c = 50, q + r = 70)

Compound 6

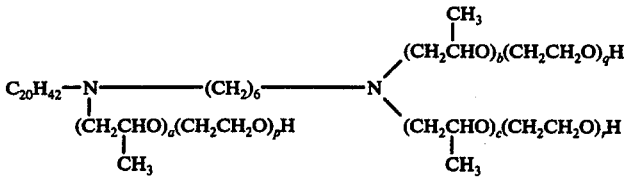

(a + b + c = 3, p + q + r = 10)

-continued

Compound 7

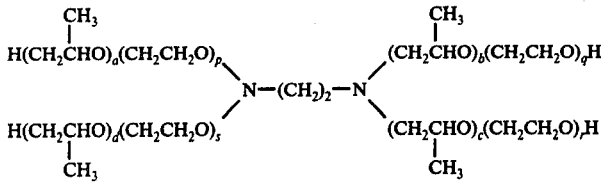

$\begin{pmatrix} a + b + c + d = 50 \\ p + q + r + s = 30 \end{pmatrix}$

Compound 8

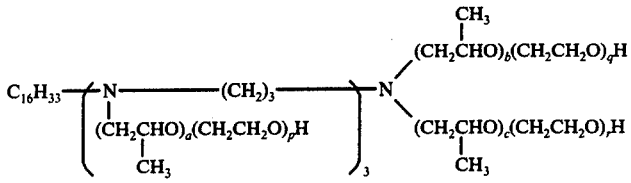

$\begin{pmatrix} 3a + b + c = 8 \\ 3p + q + r = 20 \end{pmatrix}$

Compound 9

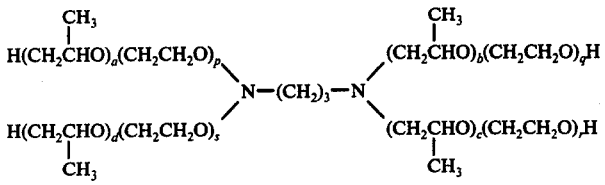

$\begin{pmatrix} a + b + c + d = 10 \\ p + q + r + s = 10 \end{pmatrix}$

Compound 10

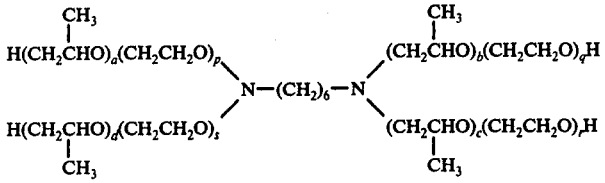

$\begin{pmatrix} a + b + c + d = 50 \\ p + q + r + s = 20 \end{pmatrix}$

Compound 11

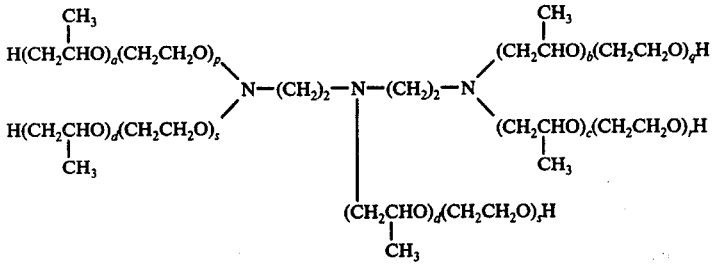

$\begin{pmatrix} a + b + c + 2d = 15 \\ p + q + r + 2s = 60 \end{pmatrix}$

Compound 12

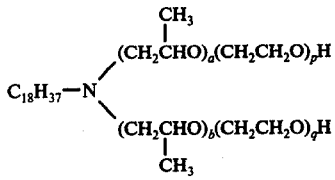

$\begin{pmatrix} a + b = 10 \\ p + q = 10 \end{pmatrix}$

Compound 13

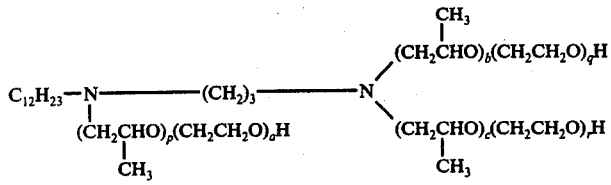

-continued $$\begin{pmatrix} a + b + c = 30 \\ p + q + r = 20 \end{pmatrix}$$

Compound 14

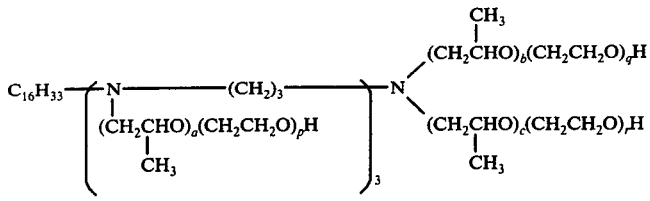

$$\begin{pmatrix} 3a + b + c = 100 \\ 3p + q + r = 30 \end{pmatrix}$$

Compound 15

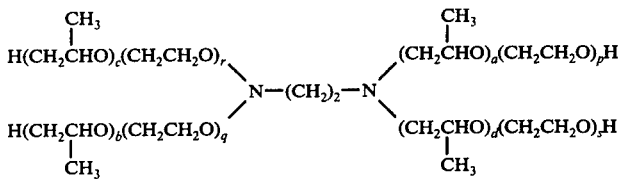

$$\begin{pmatrix} a + b + c + d = 60 \\ p + q + r + s = 20 \end{pmatrix}$$

The compounds of the above general formula (I) used in this invention can be readily obtained by reacting the corresponding amine with propylene oxide and ethylene oxide in a required amount.

If the molar ratio of the propylene oxide moieties to the ethylene oxide moieties exceeds 20, the desensitizing effect of the compound is reduced, and if the molar ratio is reduced below 0.2, the hygroscopicity of the compound is undesirably high.

The desensitizing composition of this invention contains the compound represented by the above general formula (I) as a desensitizing component and further contains, if desired, various additives.

The amount of the compound of this invention present in the desensitizing composition can vary over a wide range, but about 5 to 60 wt%, particularly about 20 to 50 wt%, of the compound of this invention is suitable. The upper limit of the amount employed is determined only by economic reasons.

The additives employed in the desensitizing composition of this invention can be the same as those utilized in conventional desensitizing compositions and include, for example, natural or synthetic high molecular weight compounds (for use, in most cases but not necessarily, as a binder) such as ketone resins, polyamide resins, maleic acid resins, phenol resins, epoxy resins, alkyd resins, melamine resins, urea resins, nitrocellulose, ethylcellulose, butyral resins, polyvinyl alcohol, gelatin or shellac; pigments (for improving the printability, brightness and hiding power) such as titanium oxide, zinc oxide, barium sulfate, magnesium carbonate, calcium carbonate, barium carbonate, magnesium hydroxide or talc; organic solvents, e.g., preferably having a boiling point of about 60° to 120° C, for example, alcohols such as methyl alcohol, ethyl alcohol, n-propyl alcohol, isopropyl alcohol, n-butyl alcohol, etc., ketones such as acetone, methyl ethyl ketone, methyl isobutyl ketone, etc., esters such as ethyl acetate, butyl acetate, etc., aromatic hydrocarbons such as benzene, toluene, xylene, naphtha, etc., glycol ethers such as ethylene glycol monomethyl ether, ethylene glycol monethyl ether, ethylene glycol monobutyl ether, diethylene glycol ethyl ether, etc.; fats and oils such as paraffins or Japan wax; vegetable oils such as linseed oil, soybean oil or cotton seed oil; antioffset agents such as starch; and other desensitizing agents such as those disclosed in U.S. Pat. No. 2,777,780, German patent application (laid open to public inspection) Nos. 2,343,800; 2,359.079; 2,361,856, U.S. patent application Ser. No. 388,710, filed Aug. 30, 1973 now abandoned, Japanese Patent Publication No. 35697/71 and Japanese Patent Application Nos. 88984/73 and 13233/73. The mixture of the compound of this invention and a polyoxyethylenealkylamine as disclosed in Japanese Patent Publication No. 29,546/71 is particularly advantageous since such a mixture exhibits a high desensitizing effect and is less hygroscopic.

The desensitizing compositions of this invention can contain the above-described components in the following proportions.

| | % by weight |
|---|---|
| High Molecular Weight Compound | 5 to 40 |
| Pigment | 5 to 60 |
| Organic Solvents | 5 to 50 |
| Fats and Oils | 5 to 20 |
| Anti-offset Agent | 0.5 to 5 |
| Other Desensitizing Agents | 1 to 80 |

The composition of this invention can be employed in various forms such as a solution in an organic solvent (for example, an alcohol solution), an aqueous dispersion, a paste or a solid. It should be noted that the effect of the composition as described above is in general not influenced by the type, the amount or the form of other components incorporated in the composition.

Thus the desensitizing composition can be readily prepared by those skilled in the art and can be applied to a color developer by printing using, e.g., relief printing or photogravure, by spraying, e.g., using a spray or by hand using the composition in a crayon-like or eraser-like form. A sufficient amount of the desensitizing composition coated generally is about 0.7 to 8 g/m$^2$, preferably about 2 to 5 g/m$^2$, as the desensitizing agent.

The color developers to which the desensitizing composition of this invention is applicable are electron attracting substances, which are well known in the art.

Examples of color developers are described in the abovedescribed patents, and specific examples of color developers are clays such as acid clay, activated clay or attapulgite; organic acids such as aromatic carboxy compounds (for example, salicylic acid), aromatic hydroxy compounds (for example, p-t-butylphenol, p-t-amylphenol, o-chlorophenol, m-chlorophenol or p-chlorophenol) or the metal salts thereof (for example, the zinc salt); mixtures of an organic acid and a metal compound such as zinc oxide; acid polymers such as phenol-formaldehyde resins or phenol-acetylene resins; and mixtures thereof. Moreover, color developers are also disclosed, for example, in U.S. Pat. Nos. 3,501,331; 3,669,711; 3,427,180; 3,455,721; 3,516,845; 3,634,121; 3,672,935; 3,732,120; and 3,772,052 and Japanese Patent Application Nos. 48,545/70; 49,339/70; 83,651/70; 84,539/70; 93,245/70; 93,247/70; 94,874/70; 109,872/70; 112,038/70; 112,040/70; 118,978/70; 118,979/70 and 86,950/71.

The color developer is coated together with a binder on the support which has already been described above. Suitable binders include, for example, latexes such as a styrene-butadiene rubber latex, a styrene-butadiene-acrylonitrile latex or a styrenemaleic anhydride copolymer latex; water-soluble natural high molecular weight compounds such as proteins (for example, gelatin, gum arabic, albumin, casein, etc.), celluloses (for example, carboxymethyl cellulose, hydroxyethyl cellulose, etc.) or polysaccharides (for example, agar, sodium alginate, starch, carboxymethyl starch, etc.); water-soluble synthetic high molecular weight compounds such as polyvinyl alcohol, polyvinyl pyrrolidone, polyacrylic acid or polyacrylamide; high molecular weight compounds which are soluble in organic solvents such as nitrocellulose, ethylcellulose polyesters, polyvinyl acetate, polyvinylidene chloride or vinyl chloride-vinylidene chloride copolymers. The above binders can be used also as a binder for a dispersion of microcapsules. The color developer layer can contain conventional additives. The color developer can be coated on a suitable support such as papers, plastic films, papers laminated with a plastic film or other supports. A suitable coating amount of the color developer can range from about 1 to 8 g/m$^2$, preferably 2 to 6 g/m$^2$, of the support.

On the other hand, color formers which form a color on reaction with the color developer are substantially colorless electron donating organic compounds and include triarylmethane compounds, diphenylmethane compounds, xanthene compounds, thiazine compounds, spiropyran compounds, or the like.

Examples of triarylmethane compounds are 3,3-bis(p-dimethylaminophenyl)-6-dimethylaminophthalide, i.e., crystal violet lactone, 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis-(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-dimethylaminophthalide, 3-p-dimethylaminophenyl-3-(1-methylpyrrol-2-yl)-6-dimethylaminophthalide, etc.

Typical examples of diphenylmethane compounds are 4,4'-bis-dimethylaminobenzhydrylbenzyl ether, N-halophenyl-lecuoauramine, N-2,4,5-trichlorophenyl-leucoauramine, etc.

Suitable examples of xanthene compounds are rhodamine B-anilinolactam, rhodamine-(p-nitroanilino)lactam, rhodamine B-(p-chloroanilino)lactam, 7-dimethylamino-2-methoxyfluoran, 7-diethylamino-2-methoxyfluoran, 7-diethylamino-3-methoxyfluoran, 7-diethylamino-3-chlorofluoran, 7-diethylamino-3-chloro-2-methylfluoran, 7-diethylamino-2,3-dimethylfluoran, 7-diethylamino-3-acetylmethylaminofluoran, 7-diethylamino-3-methylaminofluoran, 3,7-diethylaminofluoran, 7-diethylamino-3-(dibenzylamino)-fluoran, 7-diethylamino-3-(methylbenzylamino)fluoran, 7-diethylamino-3-(chloroethylmethylamino)fluoran, 7-diethylamino-3-(diethylamino)fluoran, etc.

Typical examples of thiazine compounds are benzoyl-leucomethylene blue, p-nitrobenzyl-leucomethylene blue, etc.

Examples of spiropyran compounds are 3-methyl-spirodinaphthopyran, 3-ethyl-spiro-dinaphthopyran, 3,3'-dichlorospiro-dinaphthopyran, 3-benzyl-spiro-dinaphthopyran, 3-methylnaphtho-(3-methoxybenzo)-spiropyran, 3-propyl-spiro-dibenzopyran, etc.

The color former can be easily encapsulated as microcapsules using known methods. The color former and the concentration thereof in a color former-containing oil (an oil which dissolves the color former) encapsulated in microcapsules do not impose any restriction on a method of producing microcapsules, since the oil is prepared prior to the formation of the microcapsules.

The formation of the microcapsules can be carried out, for example, using a coacervation method (as described in U.S. Pat. Nos. 2,800,457; 2,800,458; 3,041,289 and 3,687,865), an interfacial polymerization method (as described in U.S. Pat. Nos. 3,492,380 and 3,577,515, and British Pat. Nos. 950,443; 1,046,409 and 1,091,141), an internal polymerization method (as described in British Pat. No. 1,237,498 and French Pat. Nos. 2,060,818 and 2,090,862) or an external polymerization method (as described in British Pat. No. 989,264, and Japanese Patent Publication Nos. 12,380/62; 14,321/62; 29,483/70; 7,313/71 and 30,282/71).

Suitable solvents for use in dissolving the color former can be selected from a wide variety of solvents and all of the solvents known in the prior art can be used. Examples of solvents which can be used are synthetic aromatic oils such as alkylated naphthalene, alkylated biphenyl, hydrogenated terphenyl or alkylated diphenylmethane, petroleum fractions such as kerosene, naphtha or paraffin oil, vegetable oils such as cotton seed oil, soybean oil or linseed oil, or mixtures thereof.

A coating composition of microcapsules is generally a dispersion of the microcapsules and can be coated as such on a support. Moreover, a dispersion of the microcapsules can be coated on a support after adding a binder to the dispersion, for example, latexes such as a styrene-butadiene rubber latex, a water-soluble high molecular weight substance such as starch, carboxymethyl cellulose, polyvinyl alcohol, gum arabic, casein or gelatin, with or without previous separation of microcapsules.

The coating composition of microcapsules or the microcapsule layer can be contain a capsule reinforcing agent such as cellulose fine powder (as described in U.S. Pat. No. 2,711,375), a polymer fine powder (as described in U.S. Pat. No. 3,625,736) or starch fine powder (as described in British Pat. No. 1,232,347). The microcapsule reinforcing agent is scattered in the microcapsule layer or on the surface thereof preferably rather than in the form of a layer.

The above-described supports include papers, plastic films, resin-coated papers, synthetic papers, etc. The microcapsule layer can be coated completely or partially on the surface of at least one side of the support, over or under the color developer layer described below or on the surface of the opposite side of the support to the color developer layer.

The color former and the color developer can be used in a form suitable for pressure-sensitive recording sheets or heat-sensitive copying sheets as described above or for any other purposes.

This invention will be explained in greater detail by reference to the following examples, by which the excellent effects of this invention can be easily understood.

Color developer sheets, color former sheets and densensitizing compositions, which are used in the examples to demonstrate the effects of the desensitizing agents, were prepared in the following manner. All parts and percents are by weight, unless otherwise indicated.

Preparation of Color Developer Sheet A 100 parts of acid clay which had been treated with sulfuric acid was dispersed in 280 parts of water containing 10 parts of a 20% sodium hydroxide aqueous solution using a homogenizer, and to this, 10 parts of a 10% aqueous solution of the sodium salt of a methyl vinyl ether-maleic anhydride copolymer and 37 parts of a styrene-butadiene latex were added. The coating composition, Coating Composition A, was coated on a stencil paper of 50 g/m$^2$ using air knife coating so as to apply a solid content of 10 g/m$^2$ and then dried, thus providing Color Developer Sheet A.

Preparation of Color Developer Sheet B 170 parts of p-phenylphenol, 70 parts of a 37% aqueous solution of formaldehyde and 50 parts of water were condensed in the presence of conc. hydrochloric acid (as a catalyst) at 160° C and then cooled to produce a phenol resin powder.

50 parts of the phenol resin, 10 parts of polyvinyl alcohol and 500 parts of water were blended in a ball mill for 10 hours to produce a coating composition (Coating Composition B).

Coating Composition B was coated on a stencil paper of 50 g/m$^2$ so as to apply a solid content of 2 g/m$^2$ and then dried to produce Color Developer Sheet B.

Preparation of Color Developer Sheet C 4 parts of sodium hydroxide was dissolved in 200 parts of water, in which 25 parts of 3,5-di-tert-butylsalicyclic acid was dissolved while stirring.

Moreover, a solution of 7 parts of zinc chloride dissolved in 100 parts of water was slowly added while stirring. To this, 50 parts of a 10% aqueous solution of polyvinyl alcohol was added and then blended in a ball mill for 10 hours to produce Coating Composition C.

Coating Composition C was coated on a stencil paper of 50 g/m$^2$ so as to apply a solid content of 2 g/m$^2$ and then dried, thus producing Color Developer Sheet C.

Preparation of Color Developer Sheet D

A coating composition obtained by blending 35 parts of the above Coating Composition B, 50 parts of the above Coating Composition C and 15 parts of agalmatolite in a ball mill for 10 hours was coated on a stencil paper of 50 g/m$^2$ so as to apply a solid content of 2 g/m$^2$ and then dried to produce Color Developer Sheet D.

Preparation of Color Former Sheet A 10 parts of acid-treated gelatin having an isoelectric point of 8.0 and 10 parts of gum arabic were dissolved in 60 parts of water at 40° C, to which 0.2 parts of sodium alkylbenzenesulfonate was added as an emulsifier. In this, 50 parts of a color former-containing oil was emulsified.

The color former-containing oil was prepared by dissolving 2.5% by weight of crystal violet lactone and 2.0% by weight of benzoyl-leucomethylene blue in an oil comprising 4 parts of diisopropylbiphenyl and 1 part of kerosene.

When the size of the emulsion drops became 8 microns on the average, 100 parts of water at 40° C was added to prevent further emulsification.

While stirring, 210 parts of water at 30° C was further added and then a 20% hydrochloric acid aqueous solution was added to adjust the pH of the system to 4.4. The mixture was cooled to 8° C with further stirring, and then 1.5 parts of a 20% glutaraldehyde aqueous solution was added.

Subsequently, 30 parts of a 10% carboxymethylstarch aqueous solution was added, a 2.5% sodium hydroxide aqueous solution was added dropwise to adjust the pH to 8.5 and then the temperature of the system was increased to 30° C to harden the microcapsule walls.

In this composition, 10 parts of cellulose flock was dispersed and the composition was coated on a paper of 40 g/m$^2$ so as to apply a solid content of 6 g/m$^2$ to produce Color Former Sheet A.

Preparation of Color Former Sheet B

A color former-containing oil was prepared by dissolving 1% by weight of crystal violet lactone, 4% by weight of 7-diethylamino-3-dibenzylaminofluoran, 4% by weight of 3-diethylamino-7 -phenylaminofluoran, 3% by weight of 3-diethylamino-7,8-benzofluoran, 0.5% by weight of 3,6-bismethoxy-fluoran and 2% by weight of benzoyl-leucomethylene blue in an oil comprising 1 part of diisopropylnaphthalene, 1 part of diisopropylbiphenol and 2 parts of 1-(dimethylphenyl)-1-phenylethane. Color Former Sheet B using 50 parts of this color former-containing oil was prepared in the same manner as in the preparation of Color Former Sheet A.

Preparation of Desensitizing Compositions 2.5 parts of alkyd resin which had been modified with linseed oil and 75 parts of titanium oxide were uniformly blended on a three-roll mill to prepare a base composition. 4 parts of the base composition and 1 part of the desensitizing agent as shown in the following Table 1 were uniformly blended on a three-roll mill to prepare a desensitizing composition.

Test Method (A) Each desensitizing composition was coated by printing on the respective color developer sheets so as to apply 5.0 g/m$^2$ of the composition. The desensitizing area in the resulting sample and the color former sheet were placed facing each other and a load of 600 kg/cm$^2$ was applied to cause coloration. After the irradiation with ultraviolet light for 20 minutes using a Fade-o-meter, a pair of sheets was left in the dark for a day and night. The density of the sample was measured using a densitometer and the desensitizing effect was evaluated from the obtained reflection visual density (Vis. D). (B) 3.0 g of each desensitizing composition was placed in a dish of a diameter of 4.0 cm and left in an atmosphere of 40° C and 90% of relative humidity for 18 hours. The moisture absorption amount of each of the compositions were compared.

The results obtained in the evaluations described in Test Methods (A) and (B) above are shown in Table 1.

TABLE 1

| Example | Desensitizing Agent | Desensitizing Effect (Vis. D) | | | | | Moisture Absorption Amount |
|---|---|---|---|---|---|---|---|
| | | Color Former Sheet A | | | | Color Former Sheet B | |
| | | Color Developer Sheet A | Color Developer Sheet B | Color Developer Sheet C | Color Developer Sheet D | Color Developer Sheet A | |
| | | | | | | | (%) |
| Example 1 | Compound 7 | 0.05 | 0.05 | 0.05 | 0.05 | 0.07 | 5.21 |
| Example 2 | Compound 12 | 0.05 | 0.05 | 0.05 | 0.06 | 0.08 | 6.30 |
| Example 3 | Compound 13 | 0.06 | 0.05 | 0.05 | 0.06 | 0.08 | 5.01 |
| Example 4 | Compound 5 | 0.05 | 0.05 | 0.06 | 0.05 | 0.08 | 6.83 |
| Example 5 | Compound 14 | 0.05 | 0.05 | 0.05 | 0.06 | 0.08 | 2.99 |
| Example 6 | Mixture of 3 parts of Compound 15 and 1 part of Octadecylamine-Ethylene[1] Oxide Adduct | 0.05 | 0.05 | 0.05 | 0.05 | 0.08 | 6.92 |
| Comparative Example 1 | Ethylenediamine-Ethylene[2] Oxide Adduct | 0.05 | 0.06 | 0.06 | 0.05 | 0.08 | 28.6 |
| Comparative Example 2 | Octadecylamine-Propylene[3] Oxide Adduct | 0.10 | 0.15 | 0.16 | 0.16 | 0.20 | 2.10 |
| Comparative Example 3 | Octadecylamine-Ethylene[1] Oxide Adduct | 0.05 | 0.06 | 0.06 | 0.06 | 0.08 | 14.50 |
| Comparative Example 4 | Dodecyltrimethylammonium Chloride | 0.41 | 0.43 | 0.41 | 0.42 | 0.39 | 19.21 |
| Comparative Example 5 | Dodecylamine | 0.34 | 0.40 | 0.37 | 0.34 | 0.40 | 4.30 |
| Comparative Example 6 | None | 1.08 | 1.05 | 0.94 | 1.04 | 1.05 | — |

[1] $C_{18}H_{37}-N(CH_2CH_2O)_xH(CH_2CH_2O)_yH$ $x + y = 15$

[2] $(H(OCH_2CH_2)_p)(H(OCH_2CH_2)_q)N-(CH_2)_2-N(CH_2CH_2O)_rH(CH_2CH_2O)_sH$ $p + q + r + s = 20$

[3] $C_{18}H_{37}-N((CH_2CH(CH_3)O)_aH)((CH_2CH(CH_3)O)_bH)$ $a + b = 10$

The utility of the compounds of this invention can be clearly understood from the results in Table 1 above. That is, the smaller is the (Vis. D) value, the higher is the desensitizing effect, and (Vis. D.) d) value less than 0.08 means complete desensitization. Therefore, it is evident that the compounds of this invention provide complete desensitizing effects on any of the color developers such as acid clay, a phenol-formaldehyde resin or a metal salt of aromatic carboxylic acid.

Moreover, it can be seen that the compounds of this invention provide complete desensitizing effects as to the color former sheet containing 7-diethylamino-3-dibenzylfluoran and the like as color fomers.

In comparision of the moisture absorption amounts, it can be seen that the desensitizing agents used in the comparative examples having high desensitizing effects are very hygroscopic.

In regard to the desensitizing agents which absorb moisture in the moisture absorption test to an extent of greater than 10%, the moisture absorbed on coating the desensitizing composition or storing the coated papers, the binders in the composition precipitates rendering coating impossible, causing wavelike wrinkles on the coated surface or even destroying the membranes of microcapsules.

However, none of the compounds of this invention absorb moisture to an extent greater than 10% and there are no difficulties due to the absorbed moisture, as well as they are very stable under high temperature conditions.

The excellent effects of the compounds according to this invention are evident in that they exhibit extremely high desensitizing effects, are barely hygroscopic and do not yellow as do conventional amine desensitizing agents.

While the invention has been described in detail and with reference to specific embodiments thereof, it will be apparent to one skilled in the art that various changes and modifications can be made therein without departing from the spirit and scope thereof.

What is claimed is:

1. In a desensitizing composition for a color developer capable of coloring a substantially colorless color former including a natural or synthetic high molecular weight compound and a pigment, the improvement which comprises said composition containing a compound obtained by reacting an amine with propylene oxide and ethylene oxide represented by the following general formula (I)

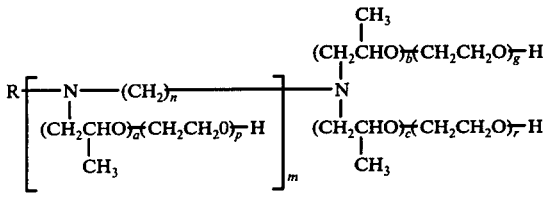

(I)

wherein R has 2 to 20 carbon atoms and represents an alkyl group, an alkenyl group, an aryl group, an aralkyl group or a

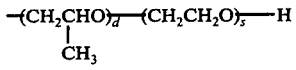

group; *m* is 0 or an integer of 1 to 3; *n* is an integer of 2 to 6; the sum of *a, b* and *c* is an integer of 3 to 100; the sum of *a, b, c* and *d* is an integer of 4 to 100; the sum of *p, q* and *r* is an integer of 3 to 100; the sum of *p, q, r* and *s* is an integer of 4 to 100 and the molar ratio of propylene oxide moieties to ethylene oxide moities is 0.2 to 20.

2. The desensitizing composition of claim 1, wherein the alkyl group for said R is a dodecyl group, a tetradecyl group, a hexadecyl group, or an octadecyl group; the alkenyl group for said R is a dodecenyl group, a tetradecenyl group, a hexadecenyl group or an octadecenyl group; the aryl group for said R is a phenyl group, a tolyl group, a naphthyl group or an α-methylnaphthyl group; and the aralkyl group for said R is a benzyl group or a phenethyl group.

3. The desensitizing composition of claim 1, wherein the sum of *a, b, c* and *d* ranges from 4 to 70, the sum of *p, q, r* and *s* ranges from 4 to 60, the ratio of $a+b+c+d$ to $p+q+r+s$ is 1:5 to 20:1 and wherein *n* is 2 or 3.

4. The desensitizing composition of claim 1, wherein said compound represented by the general formula (I) is present in said composition in an amount ranging from about 5 to 60% by weight.

5. The desensitizing composition of claim 1, wherein said other desensitizing agent is a polyoxyethylene-alkyl amine.

6. The desensitizing composition of claim 1, wherein said composition is a solution.

7. The desensitizing composition of claim 1 wherein said composition is an aqueous dispersion.

8. The desensitizing composition of claim 1, wherein said composition is a paste.

9. The desensitizing composition of claim 1 wherein said composition is a solid.

10. A method for desensitizing a color developer capable of coloring a substantially colorless color former comprising contacting a color developer with a composition containing a compound obtained by reacting an amine with propylene oxide and ethylene oxide represented by the following general formula (I)

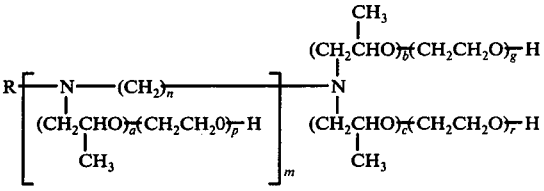

(I)

wherein R has 2 to 20 carbon atoms and represents an alkyl group, an alkenyl group, an aryl group, an aralkyl group or a

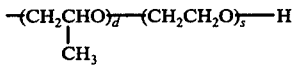

group; *m* is 0 or an integer of 1 to 3; *n* is an integer of 2 to 6; the sum of *a, b* and *c* is an integer of 3 to 100; the sum of *a, b, c* and *d* is an integer of 4 to 100; the sum of *p, q* and *r* is an integer of 3 to 100; and the sum of *p, q, r* and *s* is an integer of 4 to 100 and the molar ratio or propylene oxide moieties to ethylene oxide moieties is 0.2 to 20.

11. The method of claim 10, wherein said color developer is coated on a support as a layer, and the contacting of said desensitizing composition comprises coating said desensitizing composition on said color developer layer.

* * * * *